US005568101A

United States Patent [19]

Konishi et al.

[11] Patent Number: 5,568,101

[45] Date of Patent: Oct. 22, 1996

[54] DISTRIBUTED CONSTANT TYPE MULTIPLE-LINE CIRCUIT

[75] Inventors: Yoshihiro Konishi, Sagamihara; Yoshio Okuma, Tokyo; Yoshihiko Baba; Hideki Fujiwara, both of Ichikawa, all of Japan

[73] Assignee: Uniden Corporation, Chiba, Japan

[21] Appl. No.: 454,711

[22] Filed: May 31, 1995

[30] Foreign Application Priority Data

Apr. 25, 1995 [JP] Japan ..... 7-101200

[51] Int. Cl.[6] ..... H01P 1/213; H01P 5/12

[52] U.S. Cl. ..... 333/134; 333/136; 333/206

[58] Field of Search ..... 333/126, 127, 333/134, 136, 206, 222

[56] References Cited

U.S. PATENT DOCUMENTS 5,216,394 6/1993 Konishi et al. ..... 333/222

FOREIGN PATENT DOCUMENTS

| | | | |
|---|---|---|---|
| 235801 | 10/1987 | Japan | 333/202 DB |
| 3-3804 | 1/1991 | Japan . | |
| 4-82402 | 3/1992 | Japan . | |
| 4-119104 | 10/1992 | Japan . | |
| 5-29815 | 2/1993 | Japan . | |
| 6-13802 | 1/1994 | Japan . | |
| 6-6106 | 1/1994 | Japan . | |
| 6-29205 | 4/1994 | Japan . | |

OTHER PUBLICATIONS

Ishikawa et al., *800 MHz Power Duplexer Using TM Duel Mode Dielectric Resonators*, 1992 IEEE MTT-S, Jun. 1–5, 1992, Symposium Digest pp. 1617–1620.

*Primary Examiner*—Paul Gensler

*Attorney, Agent, or Firm*—Fish & Richardson P.C.

[57] ABSTRACT

A distributed constant type multiple-line circuit is described which comprises a dielectric block (60) having shield conductors (62,64) on its rear surface and all the peripheral side surfaces, a central conductor (1) extending in the block in the front-to-rear thickness direction at the central portion thereof, a first plurality of conductors (2–5) positioned around and parallel to the central conductor and inductively coupled therewith, and a second plurality of conductors (2'–5') positioned nearby and parallel to the first conductors and inductively coupled therewith, respectively. The length of the central conductor is equal to one quarter of the wavelength of the central frequency ($f_1$) in a frequency band, and the rear end thereof is isolated with the shield conductor on the rear surface of the block. Each of the lengths of the first conductors is equal to one quarter of the wavelength of a predetermined frequency ($f_2$–$f_5$) in the frequency band, and the rear ends thereof are shorted with the shield conductor on the rear surface of the block. Each of the lengths of the second conductors is equal to that of the corresponding one of said first conductors, and the rear ends thereof are isolated with the shield conductor on the rear surface of the block. An input signal ($S_{IN}$) iS input to the front end of the central conductor, and signal components of frequencies ($f_2$–$f_5$) are respectively output through the first conductors from the front ends of the second conductor.

10 Claims, 6 Drawing Sheets

DISTRIBUTED CONSTANT TYPE MULTIPLE-LINE CIRCUIT

BACKGROUND OF THE INVENTION

1. Field of the Invention

This invention relates to a distributed constant circuit, and more particularly to a distributed constant type multiple-line circuit, such as a multiplexer, formed as a dielectric block including a central conductor and filters placed around and connected to the central conductor.

2. Prior Art

Filters, multiplexers and so on, formed of variously shaped conductor layers on a dielectric block have conventionally been known and utilized. For example, see Japanese Patent Laid-open Official Gazette Nos. 4-82402 (1992), 5-29815 (1993), 6-6106 (1994) and 6-13802 (1994), and Laid-open Japanese Utility model Official Gazette Nos. 4-3804 (1992), 4-119104 (1992) and 6-29205 (1994). In particular, the Official Gazette No. 5-29815 (1993) discloses a circuit for a filter, multiplexer, power splitter or the like which is intended to prevent fluctuation in a resonant frequency caused by coupling with an external circuit. In order to prevent fluctuation in the frequency, the circuit employs, as a basic configuration, a dielectric resonator comprising a quarter-wavelength ($\lambda/4$) resonant line having one end shorted and the other end opened and a $\lambda/4$ coupling line having one end opened and the other end shorted wherein the coupling line is distributively inductively coupled in parallel with the $\lambda/4$ resonant line and the open end and the shorted end of the resonant line are paired with the shorted end and the open end of the coupling line, respectively. When the circuit is formed as a multiplexer or a power splitter for instance, it is configured in such a manner that an input line is positioned along the center axis of a dielectric block having a thickness equal to $\lambda/4$, with conductors deposited on peripheral surfaces and a rear surface thereof, resonant lines each having a length equal to one quarter of the wavelength of a resonant frequency are arranged on the front and rear sides of the input line, and output lines are closely arranged on the front and rear sides of the resonant lines.

SUMMARY OF THE INVENTION

It is a first object of this invention to provide a distributed constant type multiple-line circuit such as a multiplexer, power splitter, power synthesizer, which is suitable for mass-production and down-sizing.

It is a second object of this invention to provide a distributed constant type multiple-line circuit such as a multiplexer, power splitter, power synthesizer, wherein coupling degrees between adjacent filters incorporated in the circuit are able to be reduced.

It is a third object of this invention to provide a distributed constant type multiple-line circuit such as a multiplexer, power splitter, power synthesizer, which is capable of easy-adjusting and setting of coupling degrees between a central conductor and conductors for filtering in the circuit.

To achieve the first object, this invention provides a first distributed constant type multiple-line circuit comprising: (a) a dielectric block having shield conductors on its rear surface and all the peripheral side surfaces; (b) a central conductor extending in the dielectric block in the front-to-rear thickness direction at the central portion of the dielectric block, the length of the central conductor being equal to one quarter of the wavelength of the central frequency in a frequency band, and the rear end of the central conductor being isolated with the shield conductor on the rear surface of the dielectric block; (c) a first plurality of conductors positioned around and parallel to the central conductor and inductively coupled therewith, each of the lengths of the first conductors being equal to one quarter of the wavelength of a predetermined frequency in the frequency band, and the rear ends of the first conductors being shorted with the shield conductor on the rear surface of the dielectric block; and (d) a second plurality of conductors positioned nearby and parallel to the first conductors and inductively coupled therewith, respectively, each of the lengths of the second conductors being equal to that of the corresponding one of the first conductors, and the rear ends of the second conductors being isolated with the shield conductor on the rear surface of the dielectric block.

To achieve the second object, this invention provides a second distributed constant type multiple-line circuit obtained by modifying the first circuit such that the dielectric block comprises a plurality of branches radially extending from the central portion, and each pair of first and second conductors are positioned in each of said branches, thereby coupling degrees between the first conductors are reduced.

To achieve the third object, this invention provides a third distributed constant type multiple-line circuit obtained by modifying the second circuit such that the dielectric block further comprises connecting surfaces between adjacent branches and the cross-section of the central conductor has a polygonal shape so that each of the connecting surfaces substantially opposes to one of planes of the polygonal central conductor to provide a capacitance component therebetween, thereby easily adjusting capacitances therebetween and hence coupling degrees therebetween.

In the third circuit, it is also possible to provide grooves on the opposite side surfaces of each of the branches between the first and second conductors.

Further, in the third circuit, it is also possible to provide a third plurality of conductors respectively positioned between the first and second conductors and parallel thereto in the branches, and a plurality of capacitors respectively connected between the first and third conductors.

DESCRIPTION OF THE PREFERRED EMBODIMENTS

Preferred embodiments of this invention will be explained with reference to FIGS. 1–6, in which black painted out circles represent throughholes inner surfaces of which are covered with conductors, while white portions surrounding the black painted out circles represent insulation portions.

Figure 1A:
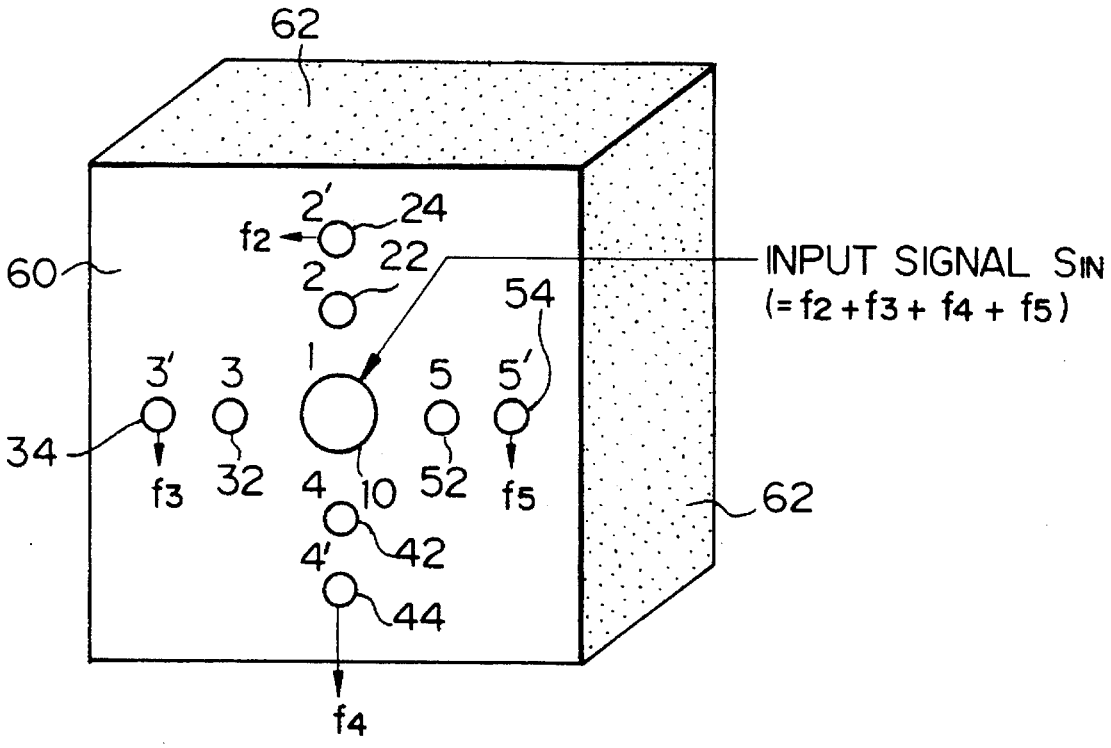
FIGS. 1A and 1B are perspective and rear views showing a first embodied multiplexer according to this invention.
Figure 1B:
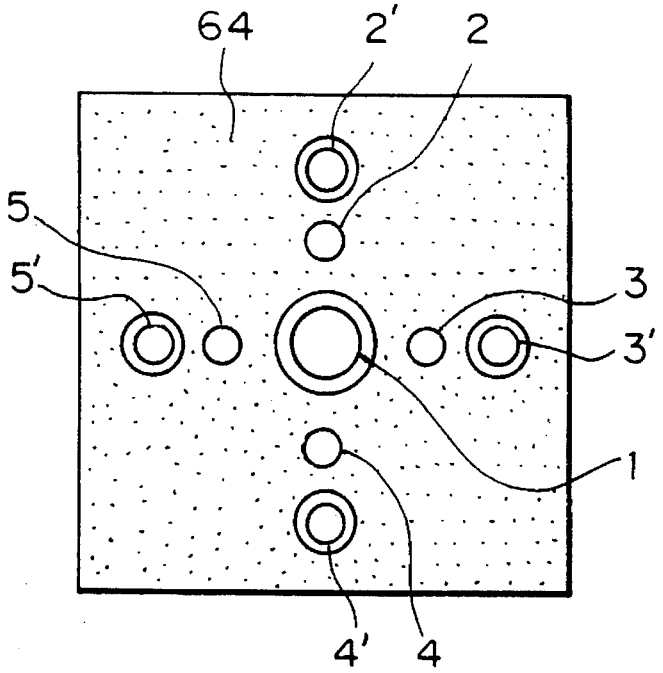

FIG. 1A shows a perspective view of a first embodied multiplexer according to this invention, viewed from the front side, which includes four different filters, and FIG. 1B shows a rear view of same. The multiplexer comprises a cubic or rectangular solid dielectric block 60 made of, e.g., ceramics having a dielectric constant of 40. The central portion of the dielectric block 60 has the front-to-rear thickness equal to one quarter of the wavelength $\lambda_1$ of the central frequency $f_1$ in a frequency band including four different frequencies $f_2$, $f_3$, $f_4$, $f_5$ wherein $f_2<f_3<f_4<f_5$. The dielectric block 60 is metalized or covered with conductive thin films on all the peripheral side surfaces to form an external surrounding conductor 62. The rear surface of the dielectric block 60 is also covered with a conductive thin film to form a rear surface conductor 64 as shown in FIG. 1B. These conductors 62, 64 are integrated with each other and grounded to serve as shield conductors. A throughhole 10 is formed through a central portion of the dielectric block 60 in the front to rear thickness direction. All the inner surface of the throughhole 10 is metalized or covered with a conductive thin film to form a central conductor 1 having the depth or length of $\lambda_1/4$. The end of the central conductor 1 on the rear surface of the dielectric block 60 is not electrically connected with the conductor 64, as shown in FIG. 1B.

The front end of the central conductor 1 serves as a signal input port which is supplied with an input signal $S_{IN}$ including components of the frequencies $f_2$–$f_5$. Accordingly, the central conductor 1 on the inner surface of the throughhole 10 and the external shield conductor 62 constitute a $\lambda_1/4$ distributed constant input line.

Above the central conductor 1, two throughholes 22, 24 are formed through the dielectric block 60 in the front-to-rear thickness direction, and conductors 2, 2' are deposited on the inner surfaces of the respective throughholes 22, 24. The thickness of the dielectric block 60 at the portion provided with the throughholes 22, 24 has been set equal to one quarter of the wavelength $\lambda_2$ of the frequency $f_2$, and thus the throughholes 22, 22 and hence the conductors 2, 2' have the length of $\lambda_2/4$. The conductor 2 deposited on the inner surface of the throughhole 22 is inductively coupled with the central conductor 1, with its end on the rear surface electrically connected with the rear surface conductor 64 as shown in FIG. 1B. A first filter is thus formed of a $\lambda_2/4$ resonator comprising the conductor 2, 62, 64, wherein the conductor 2 is inductively coupled with the central conductor 1 and the rear end of the conductor 2 is shorted with the rear surface conductor 64. The conductor 2' deposited on the inner surface of the throughhole 24, in turn, is inductively coupled with the conductor 2 of the first filter, and its end on the rear surface side is separated from the rear surface conductor 64 as shown in FIG. 1B. In this way, a first output line ($\lambda_2/4$ output line) coupled with the first filter is constituted, whereby a signal component of the frequency $f_2$ is output from the front end of the first output line.

Similarly, second–fourth filters for outputting signal components having the frequencies $f_3$, $f_4$, $f_5$ are constituted on the left, lower and right sides of the central conductor 1, respectively. The second–fourth filters will be explained in detail below. It should be noted that in this specification, when one end of a conductor deposited on the inner surface of a throughhole is electrically connected with the rear side conductor 64, this structure is expressed that the conductor is "shorted with the conductor 64", and when it is not electrically connected with the conductor 64, this structure is expressed that the conductor is "insulated from the conductor 64".

On the left side of the central conductor 1, two throughholes 32, 34 are formed through the dielectric block 60 in the front-to-rear thickness direction, and conductors 3, 3' are deposited on the respective inner surfaces thereof. The thickness of the dielectric block 60 at the portion provided with the throughholes 32, 34 has been set equal to one quarter of the wavelength $\lambda_3$ of the frequency $f_3$, and thus the throughholes 32, 34 and conductors 3, 3' have the length of $\lambda_2/4$. The conductor 3 deposited on the inner surface of the throughhole 32 is inductively coupled with the central conductor 1 and has its end on the rear surface side shorted with the conductor 64 as shown in FIG. 1B. This structure constitutes the second filter formed of a $\lambda_2/4$ resonator which is inductively coupled with the central conductor 1 and has the rear end shorted with the rear surface conductor 64. The conductor 3' deposited on the inner surface of the throughhole 34 is coupled with the conductor 3 of the second filter and has its end on the rear surface side insulated from the conductor 64 to form a second output line ($\lambda_3/4$ output line). Then, a signal component having the frequency $f_3$ is output from the front end of the conductor 3'.

Likewise, in a portion of the dielectric block 60 below the central conductor 1, which has the front-to-rear thickness equal to one quarter of the wavelength $\lambda_4$ of the frequency $f_4$, throughholes 42, 44 are formed in the thickness direction, and conductors 4, 4' are deposited on the respective inner surfaces of the throughholes 42, 44 wherein the rear end of the conductor 4 is shorted with the conductor 64 while the same of the conductor 4' is insulated therefrom as shown in FIG. 1B. Thus, the third filter formed of a $\lambda_4/4$ resonator and a third output line ($\lambda_4/4$ output line) are constituted so that a signal component having the frequency $f_4$ is output from the front end of the conductor 4'.

Further, at the right side of the central conductor 1, throughholes 52, 54 and conductors 5, 5' on the respective inner surfaces thereof are formed in the front-to-rear thickness direction of the dielectric block 60. The thickness of the dielectric block 60 at the portion provided with the throughholes 52, 54 has been set equal to one quarter of the wavelength $\lambda_5$ of the frequency $f_5$, and thus the throughholes 52, 54 and conductors 5, 5' have the length of $\lambda_2/4$. The rear end of the conductor 5 is shorted with the conductor 64 while the same of the conductor 5' is insulated therefrom as illustrated in FIG. 1B. Accordingly, the fourth filter formed of a $\lambda_5/4$ resonator and a fourth output line ($\lambda_5/4$ output line) and constituted so that a signal component having the frequency $f_5$ is output from the front end of the conductor 5'.

The multiplexer shown in FIGS. 1A, 1B is advantageous in that desired degrees of coupling of the first – fourth filters to the central conductor 1 can be obtained by adjusting the diameters of the throughholes with the conductors 2–5 on their inner surfaces and the distances between the conductors 2–5 and the central conductor 1. As will be apparent from FIGS. 1A, 1B, since the distance between adjacent filters is larger than the distances between the central conductor 1 and each of the surrounding conductors 2–5, the coupling degree between adjacent filters is small as compared with the coupling degree between the central conductor and the surrounding conductors 2–5. However, the existence of such coupling between adjacent filters itself creates problem.

Figure 2A:
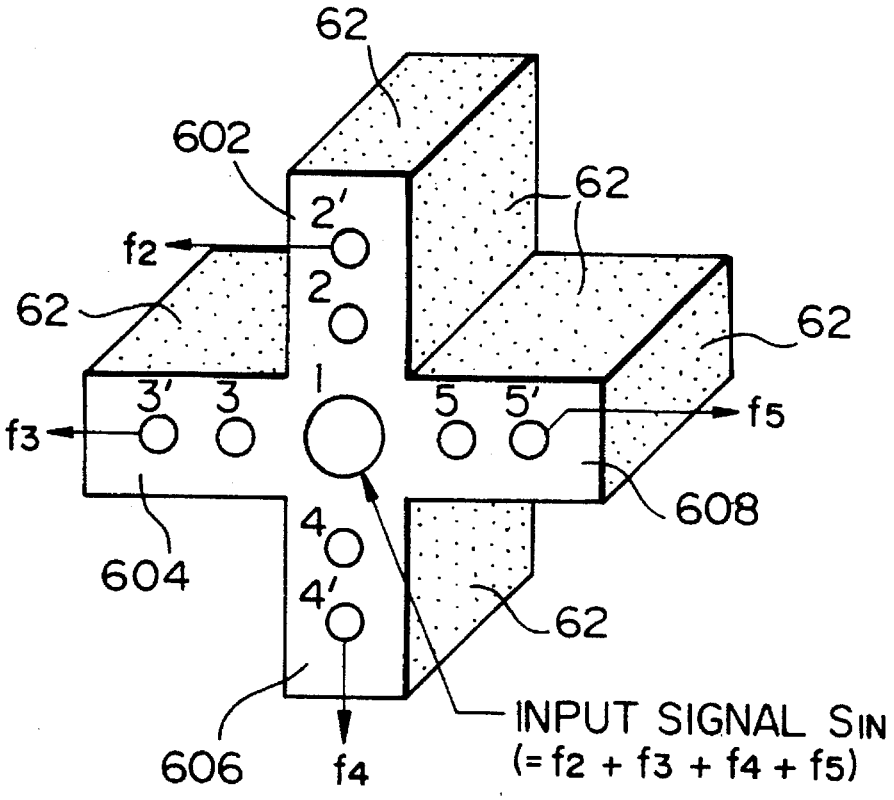
FIGS. 2A and 2B are perspective and rear views showing a second embodied multiplexer according to this invention.
Figure 2B:
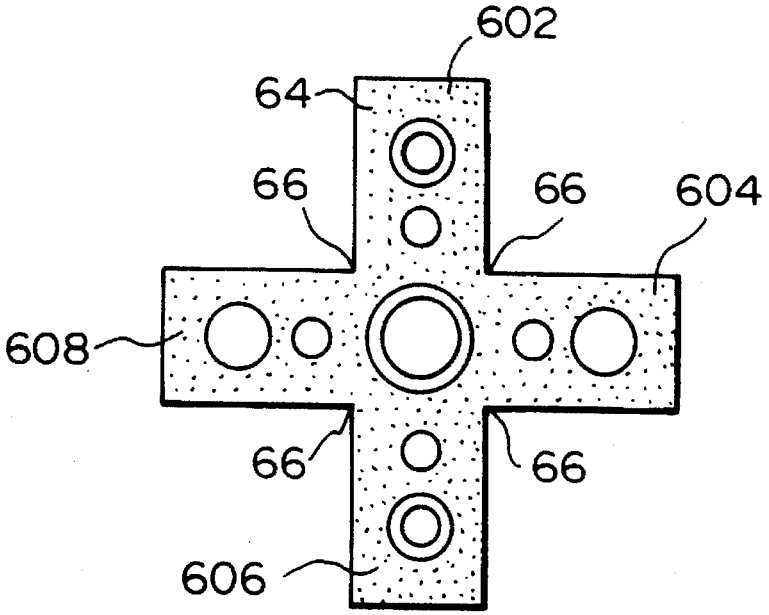

FIGS. 2A, 2B show a second embodied multiplexer according to this invention, which is capable of overcoming the above shortcoming. In FIG. 2, the same reference numerals as those in FIG. 1 designate the same components as (or similar to) those in FIG. 1. In the multiplexer shown in FIG. 2, the dielectric block 60 is formed as a cruciform block having first through fourth branches 602–608. The cruciform dielectric block 60 in FIG. 2 is formed by removing portions of the dielectric block 60 shown in FIG. 1 to leave filter portions thereof. A conductor 62 is deposited on all the peripheral side surfaces as shown in FIG. 2A and a conductor 64 is deposited on the rear cruciform surface of the dielectric block 60 as shown in FIG. 2B.

By the multiplexer having the cruciform dielectric block structure, the coupling degree between adjacent filters will be largely reduced.

The multiplexer shown in FIG. 2 can be produced by molding the cruciform dielectric block 60, forming throughholes 10, 22, 24, 32, 34, 42, 44, 52, 54 therethrough, covering the inner surfaces of the throughholes with conductors 2, 2', 3, 3', 4, 4', 5, 5', and forming the conductors 62, 64 on the peripheral side surfaces and rear surface. Accordingly, it is suitable for mass-production.

Figure 3A:
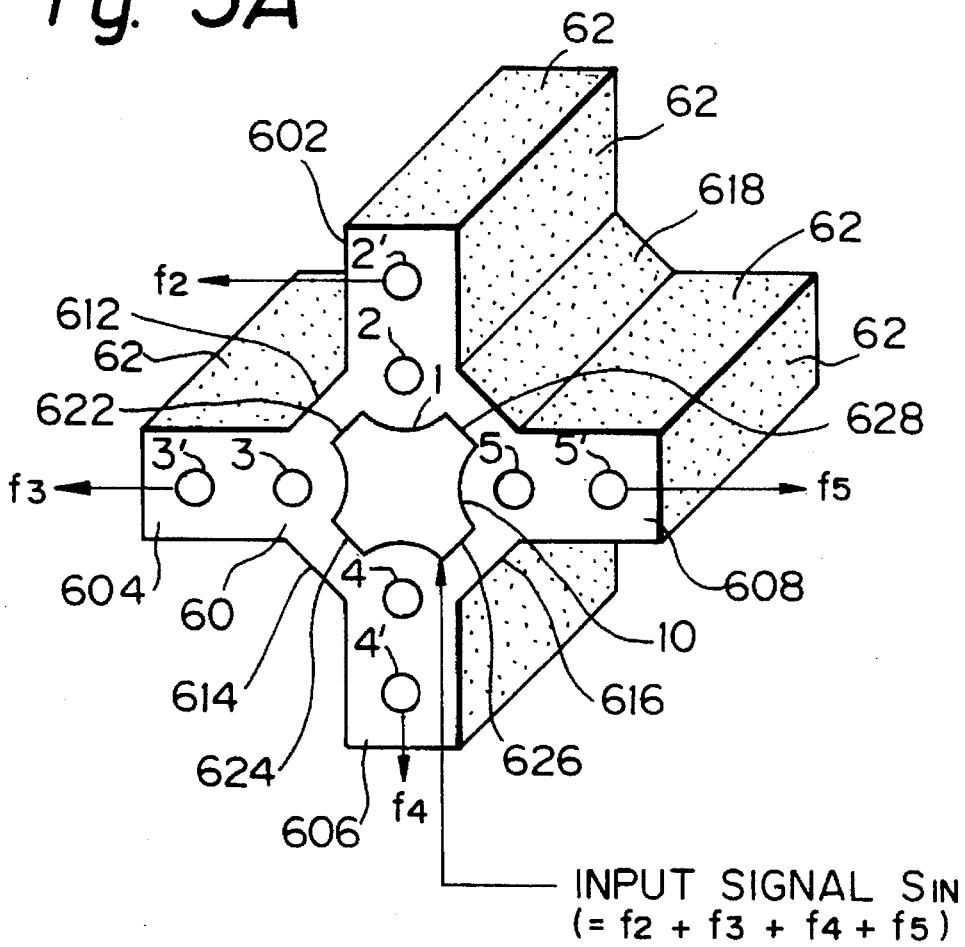
FIGS. 3A and 3B are perspective and rear views showing a third embodied multiplexer according to this invention.
Figure 3B:
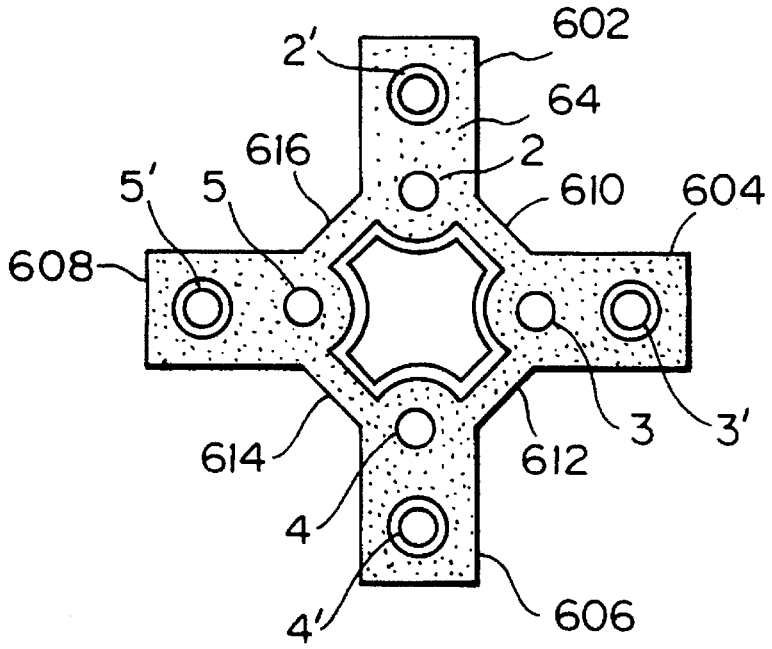

FIGS. 3A and 3B are a perspective view and a rear view showing a third embodied multiplexer according to this invention. It should be noted that the same elements in FIG. 3 as those in FIG. 2 are designated by the same reference numerals.

The multiplexer shown in FIG. 3 differs from the multiplexer shown in FIG. 2 in the following two aspects:

(1) connecting surfaces 612, 614, 616, 618 are provided for connecting bases of adjacent peripheral side surfaces of adjacent branches (for example, branches 602, 604), and the conductor 62 is also deposited on these connecting surfaces; and (2) the cross-section of the central throughhole 10 is shaped to be substantially octagonal with four surfaces 622, 624, 626, 628 opposite to the connecting surfaces 612, 614, 616, 618, and the central conductor 1 is formed on the entire inner surface of the octagonal throughhole 10.

Accordingly, capacitors are created between plane conductor portions on the opposite surfaces 622 and 612, 624 and 614, 626 and 616, 628 and 618.

In the multiplexer shown in FIG. 3, short slits (not shown) may be cut into the respective branches 602–608 in the longitudinal direction of the respective conductors from the front surface of the dielectric block 60 to couple the conductors 2–5 of the first through fourth filters with the conductors 2'–5' of the first through fourth output lines.

In the multiplexer shown in FIG. 2, adjacent peripheral side surfaces of adjacent branches, for example, the branches 602 and 604 perpendicularly intersect with each other, and thus capacitors are created between linear (not plane) conductors formed at corners 66 and the central conductor 1. Since the capacitors are provided between linear and plane conductive elements, they may largely vary even with the same structure multiplexer, and thus it is difficult to mass-produce multiplexers with substantially the same coupling degrees between the central conductors and the surrounding filters.

On the contrary, in the multiplexer shown in FIG. 3, since the capacitors are created between plane conductors, it is easy to adjust the capacitances and hence the coupling degrees between the central conductors and filters.

Figure 4:
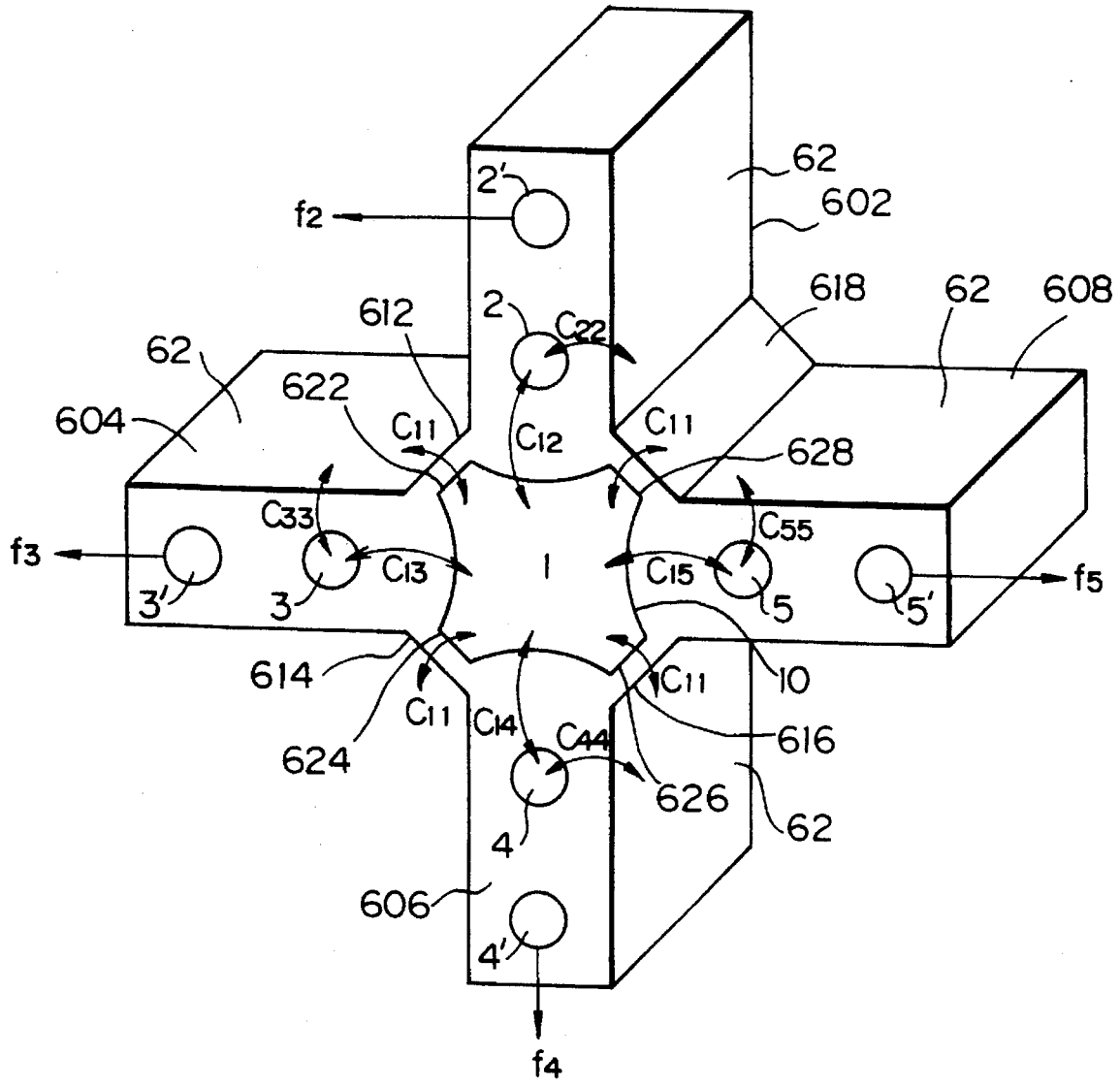
FIG. 4 is an explanatory view for explaining an operation of the multiplexer shown in FIGS. 3A and 3B.

FIG. 4 is a diagram explaining the easy-adjustment of the coupling degrees of the multiplexers shown in FIG. 3. Reference $C_{11}$ represents the sum of capacitances between the central conductor 1 and the conductor portions on the respective connecting surfaces 612, 614, 616, 618 about the central conductor 1. $C_{11}$ is thus dependent on the distances between the central conductor 1 and the respective connecting surfaces 612, 614, 616, 618, the areas and slopes of the respective connecting surfaces, and so on. Reference $C_{12}$ designates a capacitance between the central conductor 1 and the conductor 2 of the first filter or resonator; $C_{13}$ a capacitance between the central conductor 1 and the conductor 3 of the second resonator; $C_{14}$ a capacitance between the central conductor 1 and the conductor 4 of the third resonator; and $C_{15}$ a capacitance between the central conductor 1 and the conductor 5 of the fourth resonator. Reference $C_{22}$ designates a capacitance between the conductor 2 of the first resonator and the conductor 62 on the peripheral side surface of the branch 602; $C_{33}$ a capacitance between the conductor 3 of the second resonator and the conductor 62 on the peripheral side surface of the branch 604; $C_{44}$ a capacitance between the conductor 4 of the third resonator and the conductor 62 on the peripheral side surface of the branch 606; and $C_{55}$ a capacitance between the conductor 5 of the fourth resonator and the conductor 62 on the peripheral side surface of the branch 608.

The multiplexer shown in FIG. 3 can be regarded as being equivalent to a distributed constant multiple-line circuit which has the central conductor 1 electrically connected with the first–fourth filters having four parallel conductors 2–5 arranged about the central conductor 1. Mathematically analyzing the equivalent multiple-line circuit in view of the above-mentioned capacitances shown in FIG. 4, and mutual inductances between the central conductor 1 and the surrounding conductors 2–5, a coupling degree $W_k$ between each of the first–fourth filters and the central conductor 1 is expressed by:

$$W_k=(\mu\epsilon)^{-1/2}\cdot(L_{1k}^2/L_{kk})\approx\{(\mu\epsilon)^{1/2}/C_{kk}\}\cdot(C_{1k}/C_{11})^2 \quad (1)$$

A transformation ratio $n_k$ is represented as follows:

$$n_k=L_{1k}/L_{kk}=C_{1k}/C_{11} \quad (2)$$

where k is any one of 2, 3, 4 and 5 relating to the conductors 2–4, $L_{1k}$ is a mutual inductance between the central conductor 1 and a conductor k, $\epsilon$ the dielectric constant of the dielectric block 60, and $\mu$ the permeability of the dielectric block 60.

As is apparent from the above equations (1) and (2), the coupling degree $W_k$ of the filter in the multiplexer of FIG. 3 is equivalently represented by the transformation ratio $n_k$. Since $C_{1k}$ and $C_{11}$ respectively represent a capacitance between the central conductor 1 and the conductor k and a capacitance between the central conductor 1 and the part of the conductor 62 on the surfaces 612, 614, 616, 618, these values are not susceptible to large variations even if minute differences are introduced into the structure of the multiplexer during a manufacturing process. Further, since the transformation ratio $n_k$ can be changed by $C_{1k}/C_{11}$, the coupling degree between the central conductor 1 and a resonator about the central conductor 1 can be adjusted by changing the value of the capacitance $C_{11}$, thus largely facilitating the adjustment and setting of the coupling degrees between the central conductor 1 and the first–fourth filters arranged thereabout. Thus, advantageously, once a detailed structure of the multiplexer is determined, multiplexers with uniform characteristics can be mass-produced.

Figure 5:
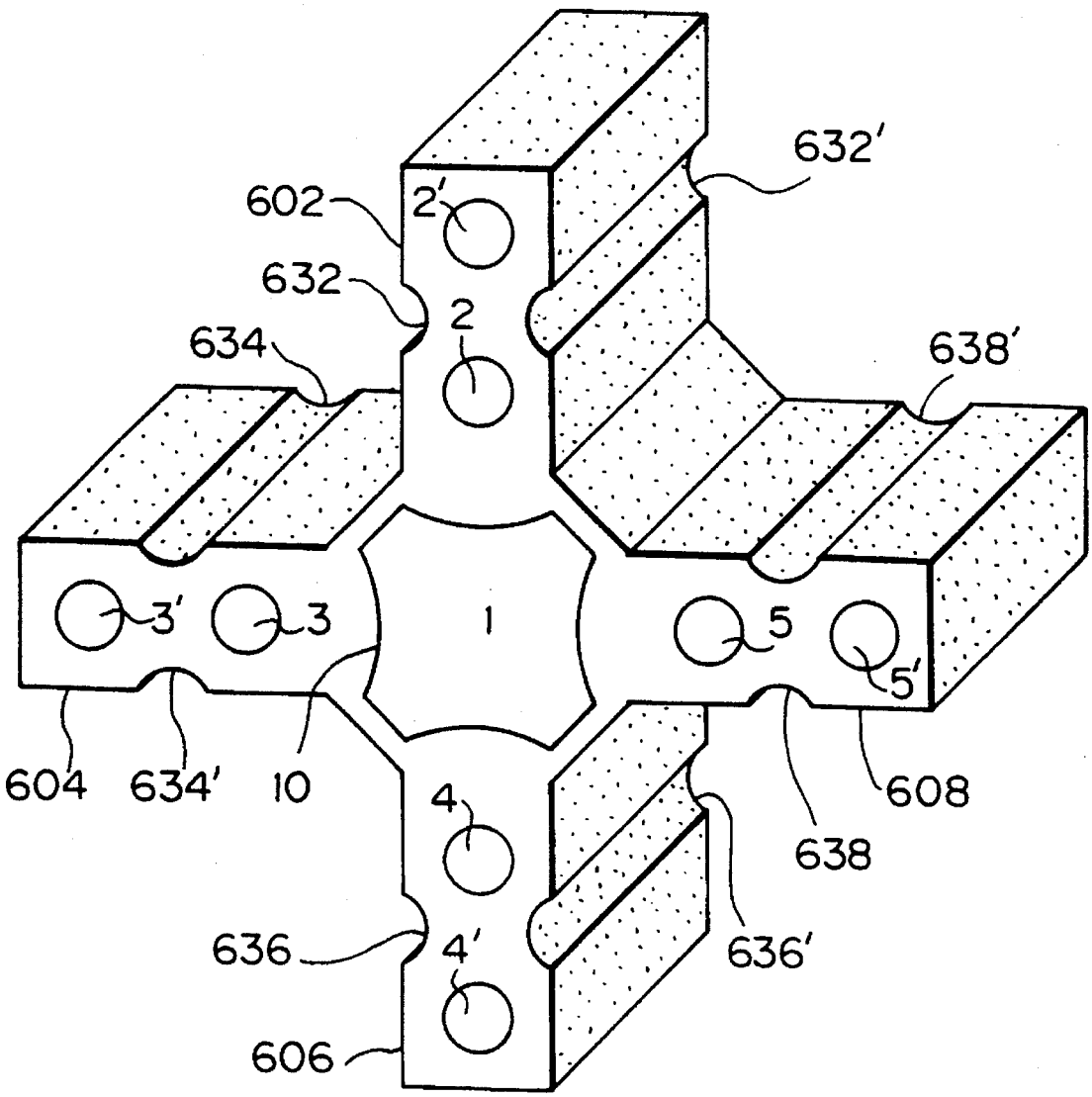
FIG. 5 shows a modified example of the multiplexer illustrated in FIGS. 3A and 3B.

FIG. 5 schematically shows a modified example of the multiplexer illustrated in FIG. 3, wherein grooves 632, 632' are formed in the opposite surfaces of the branch 602 between the conductor 2 of the first resonator and the conductor 2' of the first output line; grooves 634, 634' are formed in the opposite surfaces of the branch 604 between the conductor 3 of the second resonator and the conductor 3' of the second output line; grooves 636, 636' are formed in the opposite surfaces of the branch 606 between the third conductor 4 of the resonator and the conductor 4' of the third output line; and grooves 638, 638' are formed in the opposite surfaces of the branch 608 between the conductor 5 of the fourth resonator and the conductor 5' of the fourth output line. Since the capacitances $C_{22}$, $C_{33}$, $C_{44}$, $C_{55}$ in FIG. 4 can be varied by adjusting the depths of these grooves 632, 632', 634, 634', 636, 636', 638, 638', the coupling degree $W_k$ can also be adjusted by the formation of such grooves.

Figure 6:
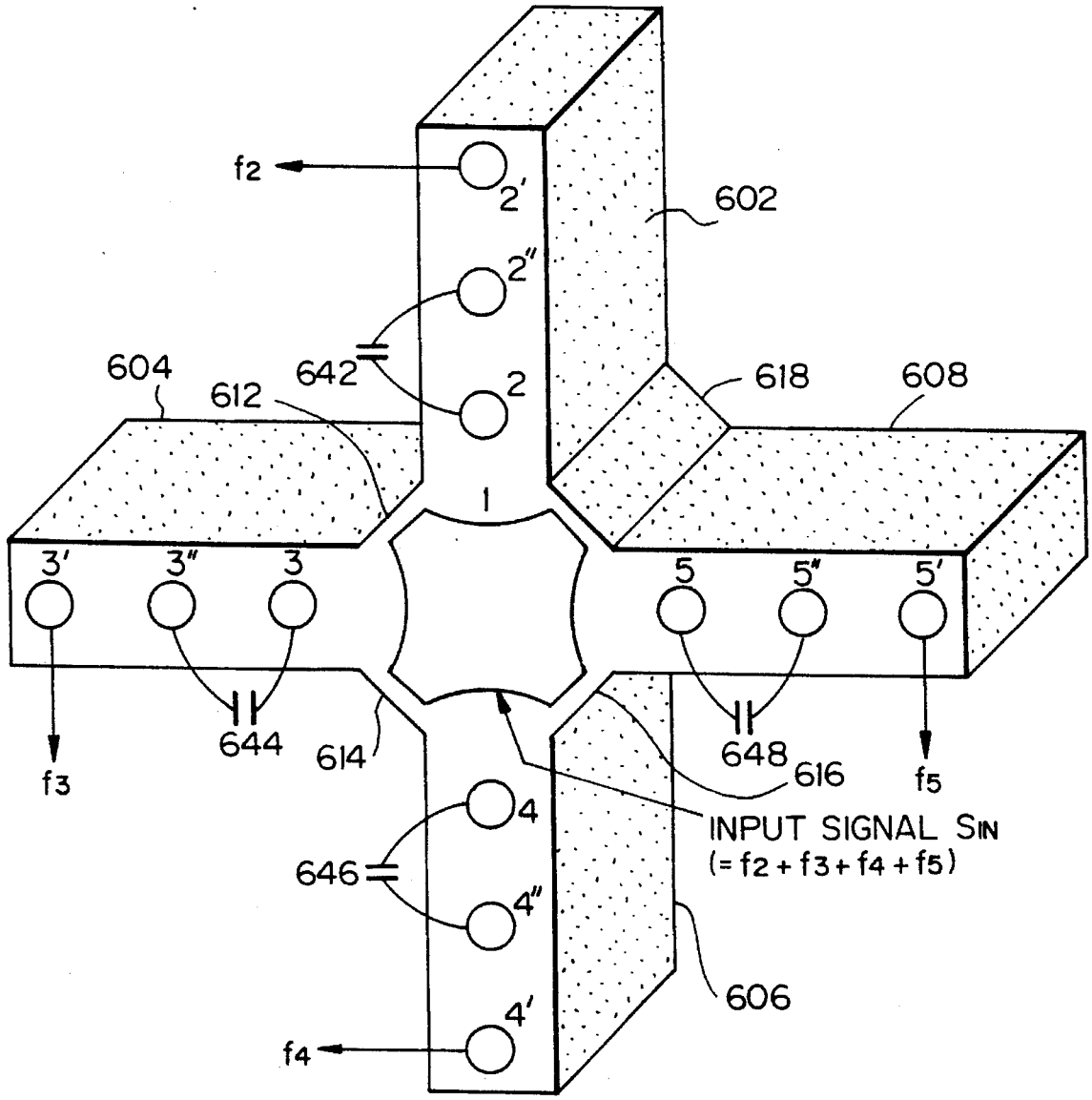
FIG. 6 shows another modified example of this multiplexer.

FIG. 6 schematically shows another modified example of the multiplexer illustrated in FIG. 3. While each of the first–fourth filters comprises a single resonator in the multiplexers so far described, the multiplexer shown in FIG. 6 has first–fourth filters each comprising two resonators which are coupled by a capacitor with each other. More specifically, in the branch 602, a conductor 2" having the same length as the conductors 2, 2' is additionally arranged between the conductors 2 and 2', with one end of the conductor 2" being shorted with the conductor 64 on the rear surface of the dielectric block 60. In this way, the first filter is constituted of two resonators, i.e., a resonator having the conductor 2 and another resonator having the conductor 2". To couple these resonators, the conductors 2 and 2" are connected by a capacitor 642.

In the branch 604, a conductor 3" having the same length as the conductors 3, 3" is additionally arranged between the conductors 3 and 3', with one end of the conductor 3" being shorted with the conductor 64 on the rear surface of the dielectric material block 60. In this way, the second filter is constituted of two resonators, i.e., a resonator having the conductor 3 and another resonator having the conductor 3". For coupling these resonators, the conductors 3 and 3" are connected by a capacitor 644. Likewise, the branches 606, 608 are additionally provided with conductors 4", 5" each having one end shorted with the conductor 64 on the rear surface of the dielectric material block 60, thus constituting third and fourth filters each comprising two resonators. The conductors 4 and 4" are connected by a capacitor 646, while the conductors 5 and 5" are connected by a capacitor 648.

The multiplexers described above with reference to FIGS. 1–6 may be further modified in the following manner.

(i) The dielectric constant of the dielectric block 60 may be an arbitrary value. Therefore, the dielectric block 60 may be removed, and the conductors 2–5 and 2'–5' forming filters and output lines may be arranged in a space surrounded by the shield conductors 62, 64.

(ii) While the foregoing description has been made on a one-to-four multiplexer in which the input signal $S_{IN}$ is supplied to the central conductor 1 and the signal components having assigned frequencies are output from the conductors 2'–5', the multiplexer according to this invention has reversible characteristics so that it is possible to utilize the same structure as a four-to-one demultiplexer in which the conductors 2'–5' are supplied with signals at respective assigned frequencies, and a signal including these frequencies is output from the central conductor 1. In this sense, the central conductor 1 and conductors 2'–5' can serve not only as signal input lines but also as output lines.

(iii) The supply of signals to the respective filters and the output of signals from the respective filters can be made in an arbitrary way. For example, in the multiplexer shown in FIG. 3, 5 or 6, the ends of the conductors 2'–5' on the rear surface side may be shorted with the rear surface conductor 64 to form resonators, and capacitors may be connected to the conductors 2'–5' so that signals are transmitted through the capacitors to/from the conductors.

(iv) A multiple-stage multiple-band multiplexer can be formed by stacking a plurality of multiplexers having a similar structure to any one or some of multiplexers shown in FIGS. 1–6 but operating at different frequency bands in the longitudinal direction of the central conductor 1 (i.e., the direction perpendicular to the plane of the drawing in FIG. 1B, 2B or 3B).

(v) While the multiplexers shown in FIGS. 1–6 each have four branches, the number of branches is not limited to four but may be an arbitrary number equal to or more than two as long as its structure permits. From a viewpoint of easier design and manufacturing, it is preferable that the multiplexer is vertically and horizontally symmetric.

(vi) While the multiplexers have been described on the assumption that the frequencies $f_2$–$f_5$ are different, the multiplexers of FIGS. 3–6 may serve as power splitters or power synthesizers if these frequencies are made equal.

(vii) In the above explanation of the multiplexer, the dielectric block 60 does not have a uniform thickness. That is, the portions respectively provided with the throughholes 10, 22 and 24, 32 and 34, 42 and 44, and 52 and 54 have different thicknesses in order to set the lengths or depths of the conductors 1, 2 and 2', 3 and 3', 4 and 4', and 5 and 5' equal to $\lambda_1/4$, $\lambda_2/4$, $\lambda_3/4$, $\lambda_4/4$, $\lambda_5/4$, respectively. However, it is also possible to constitute the dielectric block 60 such that it has a uniform thickness, and to vary the lengths of the respective conductors on the inner surfaces of the throughholes.

The invention has been described in detail with particular reference to certain preferred embodiments thereof, but it will be understood that other variations and modifications can be effected within the spirit and scope of the invention.

What is claimed is:

1. A distributed constant type multiple-line circuit comprising:

a dielectric block having shield conductors on a rear surface thereof and on peripheral side surfaces thereof;

a central conductor extending through said dielectric block in a front-to-rear thickness direction at a central portion of said dielectric block, a length of said central conductor being equal to one quarter of a wavelength of a central frequency in a frequency band, and a rear end of said central conductor being isolated from said shield conductor on the rear surface of said dielectric block;

a first plurality of conductors positioned around and parallel to said central conductor and inductively coupled therewith, a length of each of said first conductors being equal to one quarter of a wavelength of a predetermined frequency in said frequency band, and rear ends of said first conductors being shorted with said shield conductor on the rear surface of said dielectric block; and a second plurality of conductors positioned nearby and parallel to said first conductors and inductively coupled therewith, respectively a length of each of said second conductors being equal to a length of a corresponding one of said first conductors, and the rear ends of said second conductors being isolated from said shield conductor on the rear surface of said dielectric block, wherein a front end of said central conductor receives an input signal, front ends of said second plurality of conductors provide output signals, and the lengths of said central conductor and said first plurality of conductors are the same to have the same resonant frequencies so that resonant frequency signal included in said input signal is output from the front ends of said second conductors, whereby said circuit comprises a splitter.

2. A circuit according to claim 1, wherein said dielectric block is shaped into a rectangular solid.

3. A circuit according to claim 1, wherein said dielectric block comprises a plurality of branches radially extending from the central portion, and each pair of first and second conductors are positioned in each of said branches.

4. A distributed constant type multiple-line circuit comprising:

a dielectric block having shield conductors on a rear surface thereof and on peripheral side surfaces thereof;

a central conductor extending through said dielectric block in a front-to-rear thickness direction at a central portion of said dielectric block, a length of said central conductor being equal to one quarter of a wavelength of a central frequency in a frequency band, and a rear end of said central conductor being isolated from said shield conductor on the rear surface of said dielectric block;

a first plurality of conductors positioned around and parallel to said central conductor and inductively coupled therewith, a length of each of said first conductors being equal to one quarter of a wavelength of a predetermined frequency in said frequency band, and rear ends of said first conductors being shorted with said shield conductor on the rear surface of said dielectric block; and a second plurality of conductors positioned nearby and parallel to said first conductors and inductively coupled therewith, respectively, a length of each of said second conductors being equal to a length of a corresponding one of said first conductors, and the rear ends of said second conductors being isolated from said shield conductor on the rear surface of said dielectric block, wherein said dielectric block comprises a plurality of branches radially extending from the central portion, a pair of conductors from said first and second plurality of conductors is positioned in one of said branches, said dielectric block further comprises connecting surfaces between adjacent branches, and a cross-section of said central conductor is shaped so that each of said connecting surfaces substantially opposes a plane of said central conductor to provide a capacitance component therebetween.

5. A circuit according to claim 4, wherein each of said branches of said dielectric block has grooves on the opposite side surfaces thereof between said first and second conductors.

6. A distributed constant type multiple-line circuit comprising:

a dielectric block having shield conductors on a rear surface thereof and on peripheral side surfaces thereof;

a central conductor extending through said dielectric block in a front-to-rear thickness direction at a central portion of said dielectric block, a length of said central conductor being equal to one quarter of a wavelength of a central frequency in a frequency band, and a rear end of said central conductor being isolated from said shield conductor on the rear surface of said dielectric block;

a first plurality of conductors positioned around and parallel to said central conductor and inductively coupled therewith, a length of each of said first conductors being equal to one quarter of a wavelength of a predetermined frequency in said frequency band, and rear ends of said first conductors being shorted with said shield conductor on the rear surface of said dielectric block;

a second plurality of conductors positioned nearby and parallel to said first conductors and inductively coupled therewith, respectively, a length of each of said second conductors being equal to a length of a corresponding one of said first conductors, and the rear ends of said second conductors being isolated from said shield conductor on the rear surface of said dielectric block;

a third plurality of conductors respectively positioned between said first and second pluralities of conductors and parallel thereto; and a plurality of capacitors respectively connected between corresponding pairs of said first and third conductors, wherein said dielectric block comprises a plurality of branches radially extending from the central portion and a pair of conductors from said first and second plurality of conductors is positioned in one of said branches.

7. A circuit according to claim 6, wherein said dielectric block is filled with dielectric material.

8. A circuit according to claim 7, wherein said dielectric material is a ceramic.

9. A circuit according to claim 7, wherein said dielectric block further includes a plurality of throughholes, on the inner surfaces of which said central conductor and said first and second conductors are deposited.

10. A circuit according to claim 6, wherein the front end of said central conductor receives an input signal including different frequency components, the front ends of said second conductors provide output signals, and the lengths of said first conductors are different from each other to have different resonant frequencies so that said frequency components of said input signal are output from the front ends of said second conductors, respectively.

* * * * *